US008020670B2

(12) United States Patent
Mustalahti et al.

(10) Patent No.: US 8,020,670 B2
(45) Date of Patent: Sep. 20, 2011

(54) ARRANGEMENT FOR EQUALIZING ELEVATOR ROPE FORCE AND ELEVATOR

(75) Inventors: Jorma Mustalahti, Hyvinkää (FI); Esko Aulanko, Kerava (FI); Pekka Rantanen, Hyvinkää (FI)

(73) Assignee: Kone Corporation, Helsinki (FI)

( * ) Notice: Subject to any disclaimer, the term of this patent is extended or adjusted under 35 U.S.C. 154(b) by 196 days.

(21) Appl. No.: 12/230,837

(22) Filed: Sep. 5, 2008

(65) Prior Publication Data

US 2009/0050414 A1 Feb. 26, 2009

Related U.S. Application Data

(63) Continuation of application No. PCT/FI2007/000088, filed on Apr. 10, 2007.

(30) Foreign Application Priority Data

Apr. 10, 2006 (FI) ..... 20060348

(51) Int. Cl.
*B66B 7/10* (2006.01)
*B66B 11/08* (2006.01)

(52) U.S. Cl. ..... 187/264; 187/266

(58) Field of Classification Search ..... 187/404, 187/412, 264–266; *B66B 11/08, 7/10*
See application file for complete search history.

(56) References Cited

U.S. PATENT DOCUMENTS

| | | | | |
|---|---|---|---|---|
| 684,390 | A * | 10/1901 | Venn | 187/260 |
| 988,016 | A * | 3/1911 | Neenan | 187/264 |
| 2,480,865 | A * | 9/1949 | Lofstrand | 74/517 |
| 4,502,570 | A | 3/1985 | Westerlund | |
| 4,768,762 | A * | 9/1988 | Lund | 267/172 |
| 5,437,347 | A | 8/1995 | Biewald et al. | |
| 5,509,503 | A * | 4/1996 | Salmon | 187/266 |
| 6,239,362 | B1 * | 5/2001 | Nannini | 174/40 TD |

FOREIGN PATENT DOCUMENTS

| | | | |
|---|---|---|---|
| FR | 2 532 924 | | 5/1995 |
| FR | 2823734 | A1 * | 10/2002 |
| JP | 01294107 | A * | 11/1989 |
| SU | 996 318 | | 2/1983 |
| WO | WO 2004/067429 | | 8/2004 |

* cited by examiner

*Primary Examiner* — Michael R Mansen
*Assistant Examiner* — Stefan Kruer
(74) *Attorney, Agent, or Firm* — Harness, Dickey & Pierce, P.L.C.

(57) ABSTRACT

An arrangement for equalizing rope force of an elevator may include: a hoisting machine, set of hoisting ropes, traction sheave, elevator car, guide rails, and compensating device. The hoisting machine may engage the hoisting ropes via the traction sheave. The elevator car may be at least partially supported by the hoisting ropes to move the elevator car. The elevator car may move along the guide rails. The compensating device may include first and second tensioning devices. The first tensioning device may be spaced apart from the second tensioning device. The first and second tensioning devices may be interconnected via a transmission device that transmits rotary motion. A first end of the set of hoisting ropes may be secured to a point in conjunction with the first tensioning device. A second end of the set of hoisting ropes may be secured to a point in conjunction with the second tensioning device.

20 Claims, 3 Drawing Sheets

ARRANGEMENT FOR EQUALIZING ELEVATOR ROPE FORCE AND ELEVATOR

CROSS-REFERENCE TO RELATED APPLICATIONS

This application is a continuation of PCT/FI2007/000088 filed on Apr. 10, 2007, which is an international application claiming priority from FI 20060348 filed Apr. 10, 2006, the entire contents of which are hereby incorporated by reference.

BACKGROUND

1. Field

The present invention relates to an arrangement for equalizing the rope force of an elevator. The invention also relates to an elevator.

2. Description of Related Art

It is becoming increasingly common to use large suspension ratios, e.g. 3:1 . . . 9:1 and even larger, in traction sheave elevators. This generally involves the problem that, due to the many rope loops used, hoisting ropes of great length are required. For the operation and safety of the elevator, it is essential that the hoisting rope portion of the hoisting ropes below the elevator car be kept sufficiently tightly tensioned, and thus the amount of rope elongation to be compensated, or equalized, is also large. Due to the length of the adjustment distance, it is difficult to implement the required rope compensation sufficiently effectively using prior-art rope compensation devices.

Another reason requiring long ropes may be a large hoisting height of the elevator. In this case, the length of the hoisting ropes used in the elevators is also large, and therefore elevators having a large hoisting height also require a compensation arrangement capable of compensating a large elongation. In such structures, large elongations produce problems already starting from 1:1 suspension.

The construction and quality of the materials used in elevator technology as well as the control and operating systems have improved so much that nowadays it is increasingly commonly possible to implement traction sheave elevators without using a counterweight at all. In these elevator solutions, proper and reliably functioning equalization of rope forces is very important.

The rope force equalizing solutions used in prior art include solutions in which the equalization is based on various spring and lever systems. These solutions use e.g. spring or lever systems with either end of the hoisting ropes secured to them. However, a problem with such solutions is the required length of adjustment distance, because the substantially short displacement of the spring or lever does not allow a large adjustment distance and consequently does not permit compensation of large elongations. This involves at least the problem that, in the case of large suspension ratios or when long hoisting ropes are otherwise used in tall buildings, equalization of rope forces is not possible because of the length of the adjustment distance.

A better solution for equalization in cases of a long distance to be compensated would be a compensating sheave, the rim of which allows a longer compensation distance for a hoisting rope fastened to the rim than the displacement of a spring or lever. As is known, such compensating sheaves have been used for this purpose, but they also involve certain problems. One of the problems is e.g. the fact that, due to its size, the fastening of the end of the hoisting rope on the compensating sheave takes up a large space. Therefore, a compensating sheave with the hoisting rope ends fastened to it in the traditional manner according to generally known technology would have to be of a very large size to allow the elements required for the fastening to be placed on the compensating sheave. This would lead to the problem of having a complicated, large and heavy compensating sheave that is difficult to dispose in a suitable place in conjunction with other structures of the elevator. Additionally, even when compensating sheaves are used, the adjustment distance is relatively short, and thus no very large elongations can be compensated.

International patent specification no. WO2004/067429 discloses several solutions for the compensation of rope elongations. Of these solutions, especially the described block and tackle arrangements work otherwise well except that they are primarily only suited to be placed in the shaft, separately from the car.

SUMMARY

The object of the present invention is to overcome the above-mentioned drawbacks and to achieve a reliable, simple, economical, and effective arrangement for equalizing rope forces in an elevator, an arrangement that is easy to install, and enables even large elongations to be compensated. The arrangement of the invention is discussed below. The elevator of the invention is also discussed below. Some embodiments of the invention are characterized by what is disclosed in the claims.

Inventive embodiments are also presented in the description part of the present application. The inventive content disclosed in the application can also be defined in other ways than is done in the claims below. The inventive content may also consist of several separate inventions, especially if the invention is considered in the light of explicit or implicit sub-tasks or with respect to advantages or sets of advantages achieved. In this case, some of the attributes contained in the claims below may be superfluous from the point of view of separate inventive concepts. Similarly, features described in connection with each embodiment example of the invention can be applied in conjunction with other embodiments as well.

The solution of the invention has the advantage of being simple, economical, clear, versatile and effective in structure. A further advantage is that its structure allows the compensating device of the invention to be implemented as a compact component that can be placed in a small space and is thus easy to dispose in a suitable place in conjunction with other structures of the elevator, depending on the rope transmission. An additional advantage is that, when the compensating device of the invention is used, an adjustment distance of several turns can be easily provided at the end of the hoisting ropes, which allows even very large rope elongations to be compensated, so that it is possible to build elevators without counterweight having long hoisting ropes and therefore also large rope elongations or rope springing. By varying the magnitude and mutual ratio of the diameters of the transmission pulleys of the compensating device, it is possible to adjust the magnitude of the rope elongation to be compensated and the ratio between the rope forces acting on the traction sheave that can be standardized by the arrangement in question. Yet another advantage is that the suspension points can be easily disposed in a desired place and the suspension can be implemented e.g. in a centered manner as seen from above the elevator car, without any special extra functions. This is very important e.g. in the case of 1:1 suspension.

BRIEF DESCRIPTION OF THE DRAWINGS

In the following, the invention will be described in detail by referring to two different embodiment examples and the attached drawings, wherein.

DETAILED DESCRIPTION OF EXAMPLE EMBODIMENTS

Figure 1:
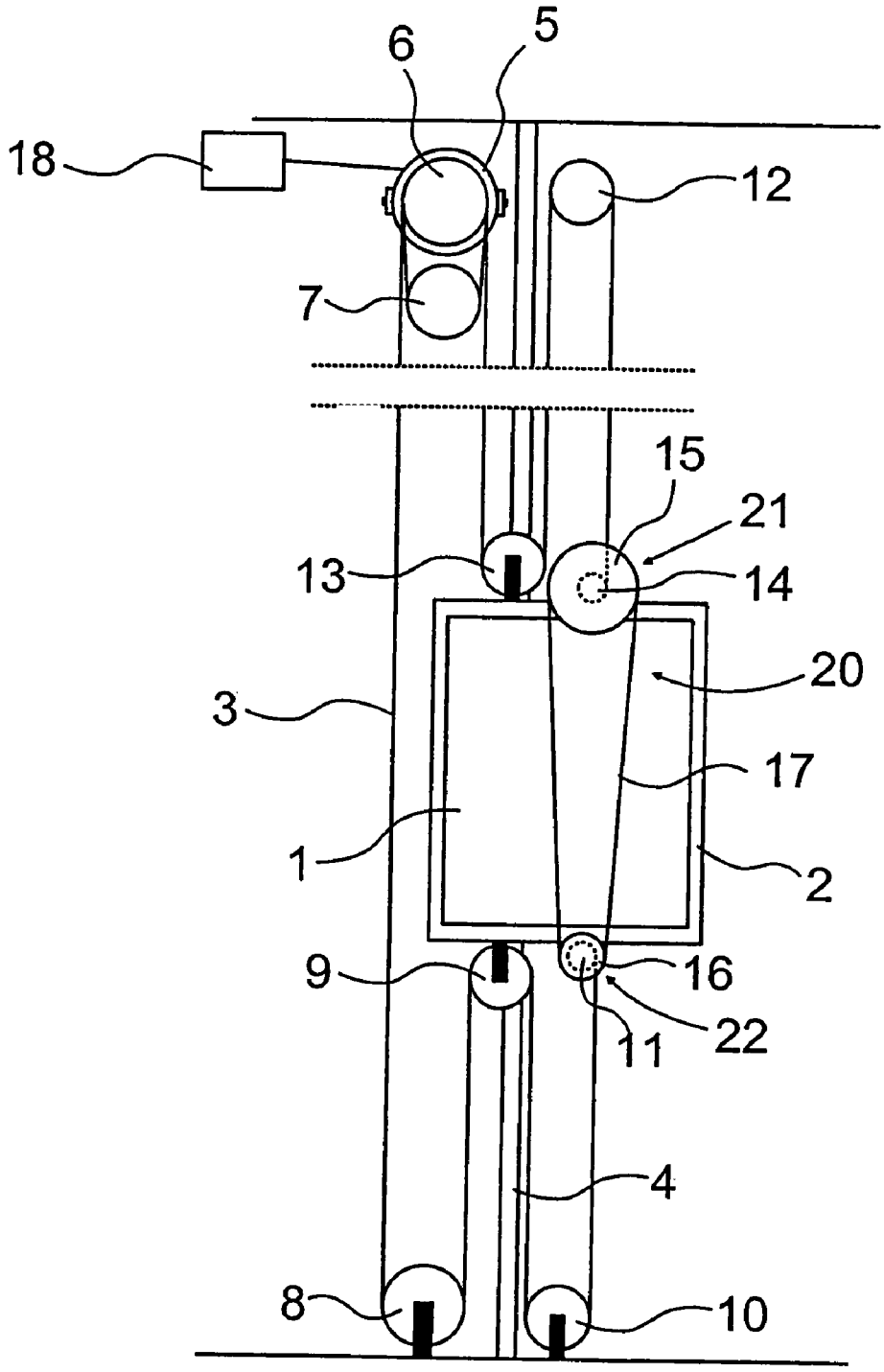
FIG. 1 presents a simplified and diagrammatic side view of an elevator solution in which an embodiment of the invention is used.
Figure 2:
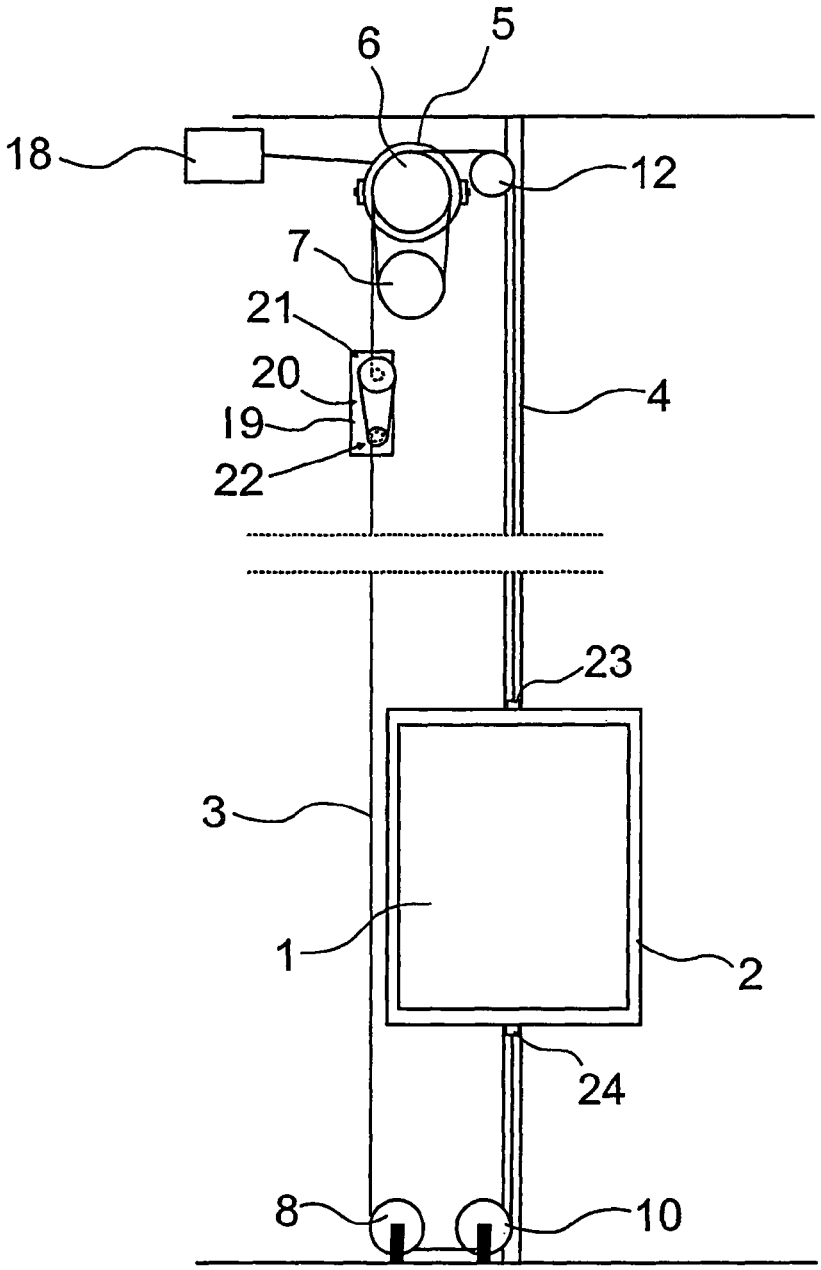
FIG. 2 presents a simplified and diagrammatic side view of an elevator solution wherein a second embodiment of the invention is used.

FIGS. 1 and 2 present simplified and diagrammatic side views of two typical traction sheave elevators in which the invention can be applied. The elevator is preferably an elevator without machine room, in which elevator the hoisting machine 5, provided with a control unit 18, together with the traction sheave 6 is mounted in the elevator shaft. The elevator type represented by each one of these figures is a traction sheave elevator with machine room above, wherein an elevator car 1 fitted inside a car frame 2 is suspended on a set of hoisting ropes 3 and the elevator car 1 is adapted to move back and forth in the elevator shaft along guide rails 4 in a substantially vertical direction. The elevator receives its hoisting power from the hoisting machine 5 by virtue of the friction between the traction sheave 6 and the hoisting ropes 3.

In the solution according to FIG. 1, the hoisting ropes 3 are secured by their first end to a reel which is mounted on the upper part of the car frame 2 and functions as a regulating element 14, and a desired number of turns of the end portions of the ropes are wound around the reel 14. To obtain a sufficiently long adjustment distance, the number of turns is at least more than one. From the reel 14, the hoisting ropes 3 are passed over a diverting pulley 12 mounted in the upper part of the elevator shaft, from where the hoisting ropes 3 are passed further under a diverting pulley 13 secured to the upper part of the car frame 2 and further to the traction sheave 6 of the hoisting machine 5 placed in the upper part of the elevator shaft. The hoisting ropes 3 are arranged to pass over the traction sheave 6 and further under a diverting pulley 7 serving as a counterpulley and placed in conjunction with the hoisting machine 5, and once more over the traction sheave 6. This arrangement allows the friction between the hoisting ropes 3 and the traction sheave 6 to be increased as compared to a solution where the hoisting ropes 3 only pass once around the traction sheave 6. Diverting pulleys 12 and 13 together with the traction sheave 6 form the suspension above the elevator car 1, where the suspension ratio is the same as the suspension ratio in the suspension below the elevator car. In the solution presented in FIG. 1, the suspension ratio is 3:1, but a different suspension ratio can be used as needed.

From the traction sheave 6 the hoisting ropes are passed downwards to the lower part of the elevator shaft, where the hoisting ropes pass under a diverting pulley 8 mounted in the lower part of the elevator shaft. From here, the hoisting ropes 3 are passed upwards over a diverting pulley 9 secured to the lower part of the car frame 2 and then further under a second diverting pulley 10 mounted in the lower part of the elevator shaft. From diverting pulley 10 the hoisting ropes 3 are passed to a reel secured to the lower part of the car frame 2 and serving as a regulating element 11, around which a desired number of turns of the end portions of the hoisting ropes 3 are wound, after which the second end of the ropes is secured to the reel 11. To obtain a sufficiently long adjustment distance, the number of turns is at least more than one.

Compensation of the hoisting ropes 3 is implemented using a rope force compensating device 20 disposed in conjunction with the elevator car 1, said device comprising at least a first or upper tensioning device 21 and a second or lower tensioning device 22, which in the example in FIG. 1 consist of the reels 14 and 11 and transmission pulleys 15 and 16. In the solution according to the example, the transmission pulley 15 of the first tensioning device 21 is connected to one end of the reel 14 secured to the upper part of the car frame 2, and the transmission pulley 16 of the second tensioning device 22 is connected to one end of the reel 11 secured to the lower part of the car frame 2. The rotary motions of the tensioning devices 21 and 22 about their central axes are coupled together via a suitable transmission ratio by having the transmission pulleys 15 and 16 interconnected by a belt serving as a transmission means 17, which is arranged to loop around the transmission pulleys so that it passes over the upper transmission pulley 15 and under the lower transmission pulley 16. The effective diameter of the upper transmission pulley 15 is greater than the effective diameter of the lower transmission pulley 16. The diameter ratio between the effective diameters of the transmission pulleys 15 and 16 determines the magnitude of the tensioning force acting on the hoisting ropes 3 and on the traction sheave 6 and therefore also the force of compensation of hoisting rope elongations. If the ratio between the forces acting on the hoisting ropes 3 in the suspension above and below the elevator car 1 is e.g. 2:1, then the effective diameter of the upper transmission pulley 15 must be substantially equal to twice the effective diameter of the lower transmission pulley 16. The ratio between the effective diameters of the transmission pulleys 15 and 16 is thus substantially the same as the ratio between the rope forces acting on the traction sheave 6.

The rope forces remain equalized and the hoisting ropes are kept tight as the tensioning devices 21 and 22 are rotating in a mutual relation determined by the transmission ratio, and the compensating device 20 simultaneously adjusts the length of hoisting ropes 3 wound around the reels at each instant. The length of hoisting ropes 3 wound around the reels 11 and 14 determines the amount of adjustment tolerance available.

FIG. 2 presents a simplified diagrammatic side view of a second typical traction sheave elevator, in which a second embodiment of the invention is used. The solution according to FIG. 2 differs from the solution of FIG. 1 e.g. in that the elevator comprises a substantially small counterweight 19, which is primarily designed to control the rope dynamics and also to provide some compensation of the weight of the elevator car 1. The suspension ratio of this elevator is 1:1 instead of 3:1. In this solution, the rope force compensating device 20, instead of being placed in conjunction with the elevator car 1, is placed in conjunction with the counterweight 19. In structure, the rope force compensating device 20 placed on the counterweight 19 substantially corresponds to the compensating device 20 placed on the elevator car 1 as illustrated in FIG. 1.

In this solution, the first end of the hoisting rope portion 3 above the elevator car is secured to a fixed anchorage 23 in the upper part of the car frame 2, from where the hoisting ropes 3 are passed e.g. over a diverting pulley 12 to the traction sheave 6 of the hoisting machine 5, which is mounted in the upper part of the elevator shaft. The hoisting ropes 3 are arranged to pass over the traction sheave 6 and further under a diverting pulley 7 placed in conjunction with the hoisting machine 5 and functioning as a counterpulley, and once more over the traction sheave 6. After this, the hoisting ropes 3 are passed to the counterweight 19, where the second end of the hoisting rope portion above the elevator car is secured to the reel of the upper tensioning device 21 of the compensating device 20 fitted in the upper part of the counterweight 19, in a manner corresponding to the solution according to FIG. 1.

Similarly, the first end of the hoisting rope portion 3 below the elevator car is secured to the reel of the lower tensioning device 22 of the compensating device 20 fitted in the lower part of the counterweight 19, in a manner corresponding to the solution of FIG. 1, while the second end is passed under diverting pulleys 8, 10 placed in the lower part of the elevator shaft and further upwards to a fixed anchorage 24 in the lower part of the car frame 2. In this solution, too, the suspension ratio in the hoisting rope portion 3 below the elevator car is 1:1. Likewise, as in the solution according to FIG. 1, the mutual difference in size of the tensioning devices 21 and 22 and transmission pulleys corresponds to the force ratios used.

Figure 3:
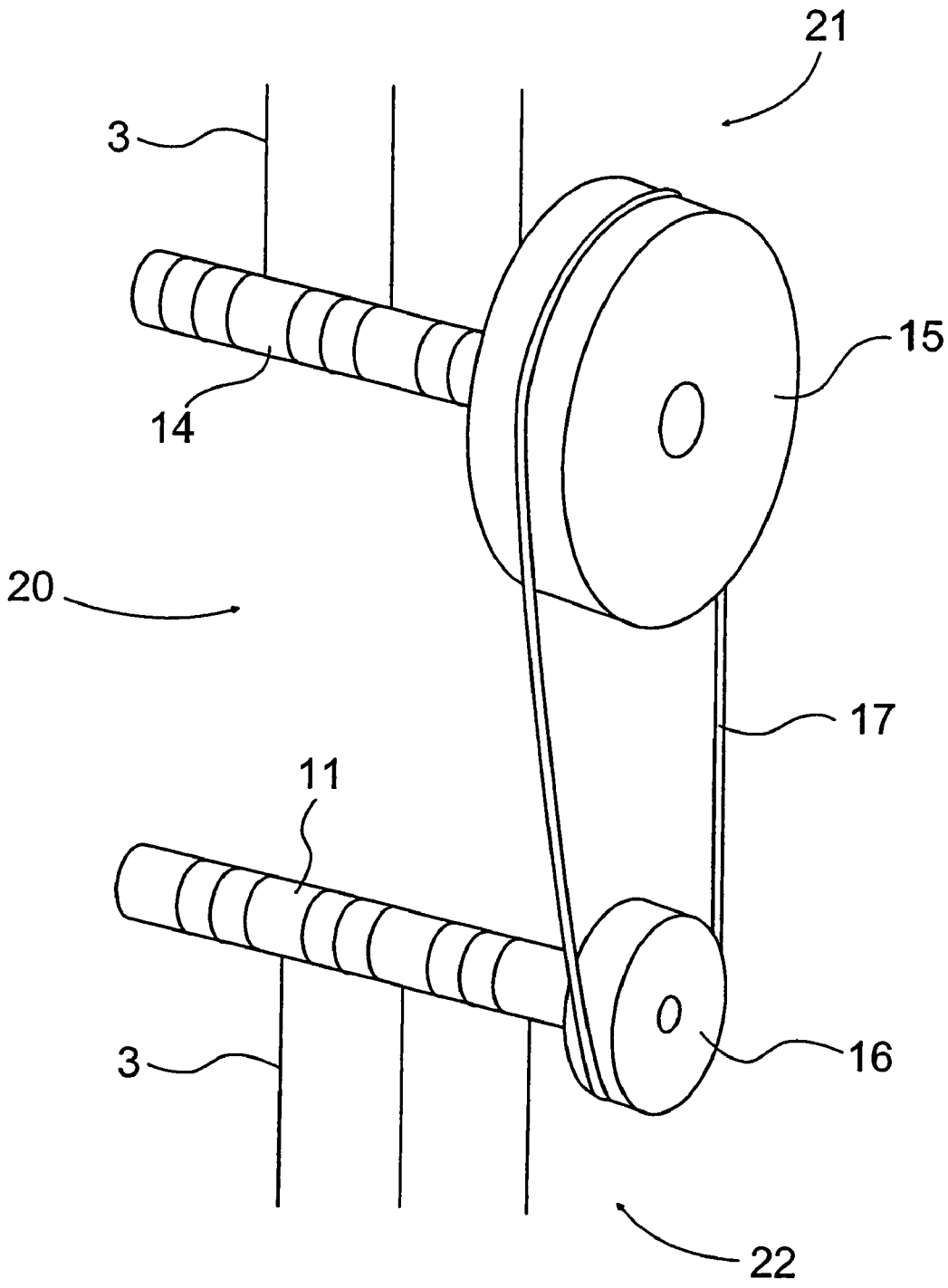
FIG. 3 presents a simplified and diagrammatic illustration of the principle of a compensating device according to the invention in oblique front view.

FIG. 3 presents a simplified and diagrammatic illustration of the principle of a compensating device 20 according to the invention as seen obliquely from the front. The compensating device 20 consists of an upper tensioning device 21, which comprises a transmission pulley 15 and a reel 14, and a lower tensioning device 22, which comprises a transmission pulley 16 and a reel 11. The transmission pulleys 15 and 16 are interconnected via a belt 17 serving as a transmission means in such a way that substantially no slip of the transmission means 17 on the transmission pulleys occurs. Thus, for example, when the first transmission pulley 15 turns about its central axis, it forces via transmission by the transmission means 17 the second transmission pulley 16 to undergo a turning motion about its central axis in a ratio determined by the transmission ratio. Corresponding transmission of rotation also works the other way round. The aforesaid transmission ratio is determined by the difference between the effective diameters of the transmission pulleys 15 and 16. In the case according to the example, the intended force ratio is 2:1, so the upper transmission pulley 15 has an effective diameter substantially twice as large as that of the lower transmission pulley 16. The force ratio is chosen according to the frictional grip provided by the traction sheave in such manner that the better the frictional grip achieved, the greater a force ratio can be used.

In the situation illustrated in FIG. 3, the set of hoisting ropes 3 consists of three hoisting ropes placed side by side, each one of which is secured by its ends to the reels 11 and 14 and wound around the reels in at least about three turns. This solution makes it possible to achieve a tolerance permitting a large adjustment of the hoisting ropes 3.

It is obvious to a person skilled in the art that different embodiments of the invention are not exclusively limited to the examples described above, but that they can be varied within the scope of the claims presented below. Thus, for example, the structure of the compensating device may vary. For example, instead of a belt, some other appropriate transmission means, such as e.g. a rope, chain or a corresponding force transmission means can be used to connect the tensioning devices. The force can also be transmitted between the tensioning devices by toothed engagement.

It is also obvious to a person skilled in the art that the invention can just as well be used with other suspension ratios and in other types of suspension besides those described in the example. For example, the number and disposal of diverting pulleys can be varied, and so can the placement of the compensating system. The compensating device may be placed e.g. in a fixed location in the elevator shaft. In practice, the compensating systems of elevators with even suspension ratios must be fixedly mounted in the elevator shaft, and the compensating systems of elevators with odd suspension ratios must be movable with the elevator car.

It is further obvious to a skilled person that the solution of the invention can also be implemented using other force ratios besides the 2:1 ratio described by way of example. The force ratio can be easily changed by altering the difference of size between the transmission pulleys.

It is additionally obvious to a skilled person that, although the 1:1 suspension described in the example comprises a small counterweight, which is primarily designed to control the rope dynamics, the invention can just as well be used in traction sheave elevators provided with a larger counterweight and also in traction sheave elevators having no counterweight at all.

It is further obvious to a skilled person that, depending on the solution, the transmission pulleys of the transmission means may also be placed side by side at substantially the same height, in which case, however, the hoisting ropes have to be somewhat longer than in the solution described above.

It is likewise obvious to a skilled person that the reels of the tensioning devices may be of mutually different diametric size, in which case the transmission ratio required for the force ratio is produced directly in the ratio between the diameters of the reels and no separate transmission pulleys are needed at all.

The invention claimed is:

1. An arrangement for equalizing rope force of an elevator, comprising:

a hoisting machine;

a set of hoisting ropes;

a traction sheave;

an elevator car;

elevator car guide rails;

a rope force compensating device;

at least one first diverting pulley above the elevator car; and at least one second diverting pulley below the elevator car;

wherein the hoisting machine engages the set of hoisting ropes via the traction sheave, wherein the elevator car is at least partially supported by the set of hoisting ropes, the at least one first diverting pulley, and the at least one second diverting pulley to move the elevator car, wherein the elevator car moves along the elevator car guide rails, wherein the rope force compensating device comprises:

a first tensioning device; and a second tensioning device;

wherein the first tensioning device includes a first axis of rotation, wherein the second tensioning device includes a second axis of rotation, wherein the first axis of rotation is spaced apart from the second axis of rotation, wherein the first and second tensioning devices are interconnected via a transmission device that transmits rotary motion, wherein the first tensioning device includes a first regulating element connected to a first transmission pulley, wherein a first end of the set of hoisting ropes is secured to the first regulating element, wherein the second tensioning device includes a second regulating element connected to a second transmission pulley, and wherein a second end of the set of hoisting ropes is secured to the second regulating element.

2. The arrangement of claim 1, wherein wherein the second regulating element substantially corresponds to the first regulating element, wherein the set of hoisting ropes is arranged to run substantially upward from the first regulating element, and wherein the set of hoisting ropes is arranged to run substantially downward from the second regulating element.

3. The arrangement of claim 2, wherein the first end of the set of hoisting ropes is coiled in at least more than one turn around the first regulating element, and wherein the second end of the set of hoisting ropes is coiled in at least more than one turn around the second regulating element.

4. The arrangement of claim 1, wherein the first and second transmission pulleys have mutually different effective diameters, and wherein the first and second transmission pulleys are interconnected via the transmission device that transmits rotary motion.

5. The arrangement of claim 1, wherein the hoisting ropes in a portion of the set of hoisting ropes substantially above the elevator car is secured by the first end to the point in conjunction with the first tensioning device, and wherein the hoisting ropes in a portion of the set of hoisting ropes substantially below the elevator car is secured by the second end to the point in conjunction with the second tensioning device.

6. The arrangement of claim 1, wherein an effective diameter of the first transmission pulley is greater than an effective diameter of the second transmission pulley by an amount corresponding to a rope force ratio used.

7. The arrangement of claim 1, wherein the rope force compensating device is disposed in conjunction with the elevator car.

8. The arrangement of claim 1, further comprising:

a counterweight;

wherein the rope force compensating device is disposed in conjunction with the counterweight.

9. An arrangement for equalizing rope force of an elevator, comprising:

a hoisting machine;

a set of hoisting ropes;

a traction sheave;

an elevator car;

elevator car guide rails; and a rope force compensating device;

wherein the hoisting machine engages the set of hoisting ropes via the traction sheave, wherein the elevator car is at least partially supported by the set of hoisting ropes to move the elevator car, wherein the elevator car moves along the elevator car guide rails, wherein the rope force compensating device comprises:

a first tensioning device; and a second tensioning device;

wherein the first tensioning device is spaced apart from the second tensioning device, wherein the first and second tensioning devices are interconnected via a transmission device that transmits rotary motion, wherein the first tensioning device includes a first regulating element connected to a first transmission pulley, wherein a first end of the set of hoisting ropes is secured to the first regulating element, wherein the second tensioning device includes a second regulating element connected to a second transmission pulley, wherein a second end of the set of hoisting ropes is secured to the second regulating element, wherein the first and second tensioning devices are provided with transmission pulleys having mutually different effective diameters, wherein the transmission pulleys are interconnected via the transmission device that transmits rotary motion, and wherein the transmission device that transmits rotary motion is a belt, toothed belt, rope, or chain.

10. An elevator, comprising:

a hoisting machine;

hoisting ropes;

a traction sheave;

an elevator car;

guide rails;

a compensating device;

at least one first diverting pulley above the elevator car; and at least one second diverting pulley below the elevator car;

wherein the hoisting machine engages the hoisting ropes via the traction sheave, wherein the elevator car is at least partially supported by the hoisting ropes, the at least one first diverting pulley, and the at least one second diverting pulley to move the elevator car, wherein the elevator car moves along the guide rails, wherein the compensating device comprises first and second tensioning devices, wherein the first tensioning device includes a first axis of rotation, wherein the second tensioning device includes a second axis of rotation, wherein the first axis of rotation is spaced apart from the second axis of rotation, wherein the first and second tensioning devices are interconnected via a transmission device that transmits rotary motion, wherein the first tensioning device includes a first regulating element connected to a first transmission pulley, wherein a first end of the hoisting ropes is secured to the first regulating element, and wherein a second end of the hoisting ropes is secured to the second regulating element.

11. The elevator of claim 10, further comprising:

a counterweight;

wherein the counterweight is at least partially supported by the hoisting ropes.

12. The elevator of claim 11, wherein the first tensioning device is directly or indirectly mounted to the counterweight.

13. The elevator of claim 11, wherein the second tensioning device is directly or indirectly mounted to the counterweight.

14. The arrangement of claim 10, wherein the second regulating element substantially corresponds to the first regulating element, wherein the set of hoisting ropes is arranged to run substantially upward from the first regulating element, and wherein the set of hoisting ropes is arranged to run substantially downward from the second regulating element.

15. The arrangement of claim 14, wherein the first end of the hoisting ropes is coiled in at least more than one turn around the first regulating element, and wherein the second end of the hoisting ropes is coiled in at least more than one turn around the second regulating element.

16. The elevator of claim 10, wherein the elevator is without counterweight.

17. The elevator of claim 10, wherein the first tensioning device is directly or indirectly mounted to the elevator car.

18. The elevator of claim 10, wherein the second tensioning device is directly or indirectly mounted to the elevator car.

19. The elevator of claim 10, wherein the first and second tensioning devices are provided with transmission pulleys having mutually different effective diameters, and wherein the transmission pulleys are interconnected via the transmission device that transmits rotary motion.

20. The elevator of claim 10, wherein a portion of the hoisting ropes substantially above the elevator car is secured by the first end to the point in conjunction with the first tensioning device, and wherein a portion of the hoisting ropes substantially below the elevator car is secured by the second end to the point in conjunction with the second tensioning device.

* * * * *